US011664626B2

(12) United States Patent
Hu et al.

(10) Patent No.: US 11,664,626 B2
(45) Date of Patent: May 30, 2023

(54) STAGGERED PRESS-FIT FISH-EYE CONNECTOR

(71) Applicant: Dell Products L.P., Round Rock, TX (US)

(72) Inventors: Sandburg Hu, Shanghai (CN); Bhyrav Mutnury, Austin, TX (US); Lynn Kong, Shanghai (CN)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/388,214

(22) Filed: Jul. 29, 2021

(65) Prior Publication Data

US 2023/0030359 A1 Feb. 2, 2023

(51) Int. Cl.

| | |
|---|---|
| ***H01R 13/6471*** | (2011.01) |
| ***H01R 12/71*** | (2011.01) |
| ***H01R 13/05*** | (2006.01) |
| *H01R 12/70* | (2011.01) |

(52) U.S. Cl.

CPC ..... *H01R 13/6471* (2013.01); *H01R 12/712* (2013.01); *H01R 13/05* (2013.01); *H01R 12/707* (2013.01)

(58) Field of Classification Search

CPC .... H01R 12/724; H01R 12/58; H01R 12/707; H01R 12/712; H01R 13/6471; H01R 13/05; H01R 13/41

USPC ..... 439/751, 82, 84, 825

See application file for complete search history.

(56) References Cited

U.S. PATENT DOCUMENTS

| | | | | | |
|---|---|---|---|---|---|
| 2,064,545 | A * | 12/1936 | Kleinmann | H01R 13/04 | 439/825 |
| 4,362,353 | A * | 12/1982 | Cobaugh | H01R 12/58 | 439/70 |
| 4,384,757 | A * | 5/1983 | Andrews, Jr. | H05K 7/10 | 439/825 |
| 4,526,429 | A * | 7/1985 | Kirkman | H01R 12/58 | 439/825 |
| 5,429,520 | A * | 7/1995 | Morlion | H01R 12/712 | 439/607.05 |
| 5,543,586 | A * | 8/1996 | Crane, Jr. | H01L 23/49811 | 361/776 |
| 6,048,232 | A * | 4/2000 | Chen | H01R 13/422 | 439/825 |
| 6,106,308 | A * | 8/2000 | Chen | H01R 12/58 | 439/79 |
| 6,146,166 | A * | 11/2000 | Muzslay | H01R 13/052 | 439/825 |
| 6,379,198 | B1 * | 4/2002 | Arnett | H01R 4/2429 | 439/825 |

(Continued)

*Primary Examiner* — Marcus E Harcum

(74) *Attorney, Agent, or Firm* — Larson Newman, LLP

(57) ABSTRACT

A staggered press-fit fish-eye connector for an information handling system includes multiple ground press-fit connectors and multiple signal press-fit connectors. The ground press-fit connectors include first, second, and third ground press-fit connectors. The signal press-fit connectors include first, second, third and fourth signal press-fit connectors. The ground press-fit connectors are substantially longer than the signal press-fit connectors. The first and second signal press-fit connectors are located between the first and second ground press-fit connectors, and the third and fourth signal press-fit connectors are located between the second and third ground press-fit connectors.

20 Claims, 3 Drawing Sheets

(56) References Cited

U.S. PATENT DOCUMENTS 6,817,870 B1 * 11/2004 Kwong ..... H05K 3/368 439/74
7,833,026 B1 * 11/2010 Morgan ..... H01R 12/722 439/607.05
7,909,668 B2 * 3/2011 McAlonis ..... H01R 13/052 439/930
8,057,240 B2 * 11/2011 Morgan ..... H01R 12/58 439/55
8,613,622 B2 * 12/2013 Garcia ..... H01R 13/2421 439/75
8,622,751 B2 * 1/2014 Lappoehn ..... H05K 3/308 439/62
9,106,009 B2 * 8/2015 Zhao ..... H01R 12/585
9,431,733 B1 * 8/2016 Heistand ..... H01R 12/585
10,003,145 B1 * 6/2018 Annis ..... H01R 12/716
2002/0055304 A1 * 5/2002 Arnett ..... H01R 4/2429 439/825
2008/0207015 A1 * 8/2008 Sueyoshi ..... H05K 3/325 439/75
2009/0035964 A1 * 2/2009 Yamamoto ..... H01R 12/712 439/79
2010/0015822 A1 * 1/2010 Morgan ..... H01R 13/6474 439/83
2010/0267252 A1 * 10/2010 Fujimoto ..... H01G 9/10 439/825
2012/0167386 A1 * 7/2012 Goergen ..... H05K 3/429 29/852
2014/0302723 A1 * 10/2014 Zhao ..... H01R 12/585 439/751
2016/0050756 A1 2/2016 Mundt et al.
2016/0261075 A1 * 9/2016 Laurx ..... H01R 12/585
2019/0089095 A1 * 3/2019 Toda ..... H01R 13/6474
2019/0131723 A1 * 5/2019 Txarola ..... H01R 13/40
2020/0136315 A1 * 4/2020 Tanaka ..... H01R 13/6585
2020/0280142 A1 * 9/2020 Hung ..... H01R 9/24
2021/0226361 A1 * 7/2021 Mason ..... H01R 13/6471
2021/0234290 A1 * 7/2021 Dunham ..... H01R 12/58
2021/0265752 A1 * 8/2021 Guillot ..... H01R 13/6473
2022/0052469 A1 * 2/2022 Huang ..... H01R 12/58
2022/0173555 A1 * 6/2022 Little ..... H01R 13/6597
2022/0271458 A1 * 8/2022 Wang ..... H01R 12/737

* cited by examiner

STAGGERED PRESS-FIT FISH-EYE CONNECTOR

FIELD OF THE DISCLOSURE

The present disclosure generally relates to a staggered press-fit fish-eye connector in an information handling system.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, networking systems, and mobile communication systems. Information handling systems can also implement various virtualized architectures. Data and voice communications among information handling systems may be via networks that are wired, wireless, or some combination.

SUMMARY

A staggered press-fit fish-eye connector for an information handling system includes multiple ground press-fit connectors and multiple signal press-fit connectors. The ground press-fit connectors include first, second, and third ground press-fit connectors. The signal press-fit connectors include first, second, third and fourth signal press-fit connectors. The ground press-fit connectors may be substantially longer than the signal press-fit connectors. The first and second signal press-fit connectors are located between the first and second ground press-fit connectors, and the third and fourth signal press-fit connectors are located between the second and third ground press-fit connectors.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

Figure 1:
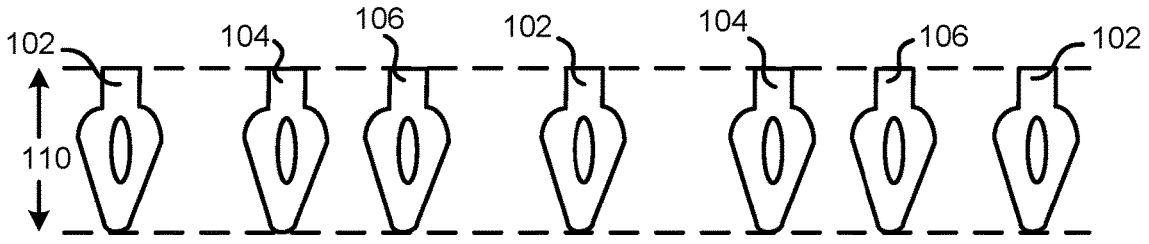
FIG. 1 (Prior Art)
FIG. 1 is a diagram of a press-fit fish-eye connector according to the prior art.

FIG. 1 illustrates press-fit fish-eye connectors 102, 104, and 106 according to the prior art. In an example, press-fit fish-eye connectors 102 are connectors for a ground pin, press-fit fish-eye connectors 104 and 106 are connectors for signals pins. A set of connectors 104 and 106 is located between two ground connectors 102. Ground connectors 102 may provide shielding between one set of connectors 104 and 106 and another set of connectors 104 and 106. A set of connectors 104 and 106 may be a differential pair.

Signal connectors 104 and 106 may transmit any type of signal including, but not limited to, low speed signals and high speed signals. Press-fit fish-eye connectors 102, 104, and 106 shown in FIG. 1 may be a portion of an overall number of connector pins in a communication connector. In certain examples, high speed signals utilize any suitable percentage of the communication connector including, but not limited to, 50%, 40%, 30%, and 20% of all signal connectors. According to the prior art, press-fit fish-eye connectors 102, 104, and 106 are all a same length 110. Press-fit fish-eye connectors 102, 104, and 106 may be any suitable length 110 to provide mechanical strength and rigidity when pressed into a printed circuit board (PCB), such as PCB 200 of FIG. 2. Length 110 of press-fit fish-eye connectors 102, 104, and 106 may be 50 millimeters, 55 millimeters, 60 millimeters, or the like.

Figure 2:
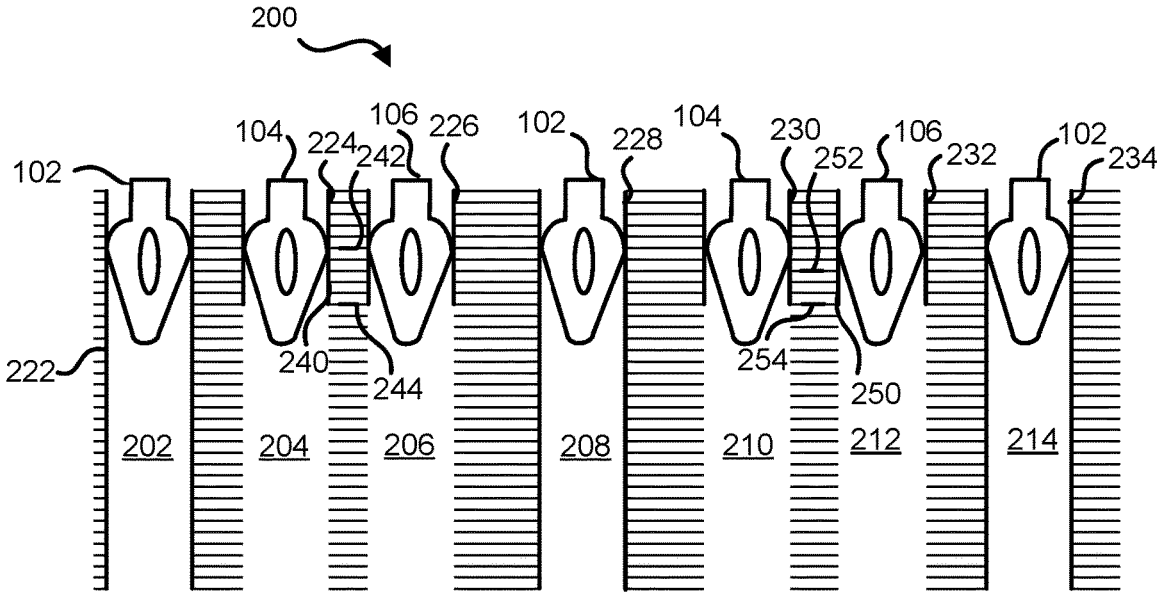
FIG. 2 (Prior Art)
FIG. 2 is a diagram of the press-fit fish-eye connector within a printed circuit boards (PCB) according to the prior art.

FIG. 2 illustrates PCB 200 with press-fit connectors 102, 104, and 106 pressed into the PCB according to the prior art. PCB 200 represents circuit boards that provide a desired function for data processing, such as an information handling system. PCB 200 provides circuit traces, and component pads and through-hole mounting locations for the components that provide the functions and features of the information handling system. As such, PCB 200 will be understood to be fabricated as a multi-layer PCBs with various circuit traces formed on the front and back surfaces of the add-in card PCB, with various signal layers, power layers, and ground layers, and the like. The various circuit traces and layers may be formed of gold, nickel, tin, tin-lead, or other materials, as needed or desired.

The circuit trace layers, ground layers, and power layers are sandwiched between insulating layers of PCB material which may include pre-pregnated fiberglass, Duroid, FR4, epoxy resin, or the like, as needed or desired. The circuit trace layers, ground layers, and power layers may include copper layers, aluminum layers, iron layers, or the like, as needed or desired. In an assembly process of the information handling system, various components are placed onto PCB 200 in through-hole mounting locations, surface mounting locations, and the like, and in a solder reflow process, the connections of the components are electrically connected to the PCB. The details of PCB design and manufacturing, and electronic device assembly onto a PCB are known in the art, and will not be further described herein, except as needed to illustrate the current embodiments.

Among the various components that are assembled onto a PCB may include components that provide a high-speed data communication interface that is routed by the PCB between the components, or to connectors assembled onto the PCB to provide the high-speed data communication interface to other components, such as add-in cards, network connections, date connections, or other interfaces to components external to the PCB. Such high-speed data communication interfaces may be single-ended data communication interfaces, where data is transmitted over a single trace and data is communicated with reference to a reference voltage, typically a ground voltage level, or the high-speed data communication interface may be double-ended data communication interfaces, where data is transmitted over a pair of signal traces and data is communicated as a differential signal between the pair of traces. As the speed of high-speed data communication interfaces increases, and the typical distance between the traces decreases, the susceptibility of the high-speed data communication interfaces to cross-talk from other nearby signal sources also increases.

PCB 200 includes multiple vias 202, 204, 206, 208, 210, 212, and 214, and each of the vias may be plated to provide communication between a press-fit fish-eye connector and one or more layers of PCB 200. During the assembly of PCB 200, via 202 may be plated with plating 222, via 204 may be plated with plating 224, via 206 may be plated with plating 226, via 208 includes at plating 228, via 210 may be plated with plating 230, via 212 may be plated with plating 232, and via 214 may be plated with plating 234.

If a ground connector will be pressed into a via, the entire plating may be left on the inner surface of the via, such as plating 222 on via 202, plating 228 on via 208, and plating 234 on via 214. If a signal connector is to be pressed into a via, the via may be back drilled to remove a portion of the plating, such as plating 224 on via 204, plating 226 on via 206, plating 230 on via 210, and plating 232 on via 212. In previous PCBs, such as PCB 200, an amount of the plating of a via that may be backdrilled may be based on any suitable factors including, but not limited to, a length of the press-fit fish-eye connector to be pressed into the via.

Some high speed signal protocols, such as peripheral component interconnect express 5 (PCIe5), may be affected by signal reflections generated by stubs that are longer than a predetermined amount and connected to the communication layer. A stub 240 may be formed by a portion of plating 224 extending from a layer 242 of PCB 200 coupled to the plating and an end 244 of the plating. The length of plating 224 remaining in PCB 200 after via 204 being backdrilled may prevent particular high speed signal protocols from being utilized on layer 242 of the PCB.

The remaining length of plating 224 may form stub 240, which may be too long for the high speed signal protocol. A stub 250 may be formed by a portion of plating 230 extending from a layer 252 of PCB 200 coupled to the plating and an end 254 of the plating. The length of plating 230 remaining in PCB 200 after via 210 being backdrilled may substantially equal to the length of plating 224. Layer 252 may be a lower layer within PCB 200, such that stub 250 is short enough to enable the high speed signal protocol to be utilized on layer 252. Information handling systems and PCBs may be improved to enable high speed protocol to be utilized by reducing the lengths of stubs as will be described with respect to FIGS. 3 and 4.

Figure 3:
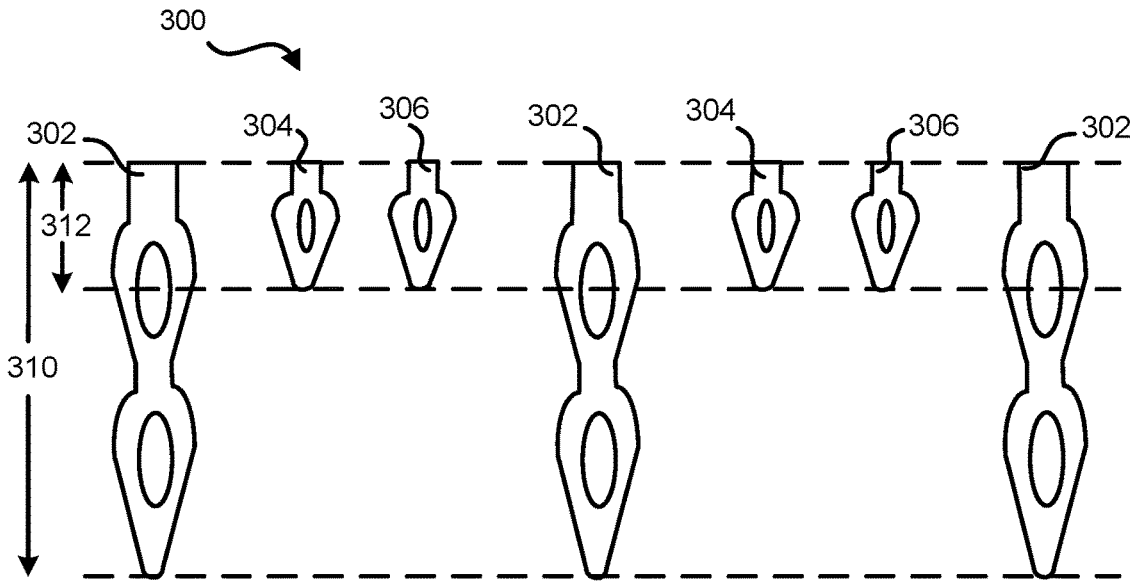
FIG. 3 is a diagram of a staggered press-fit fish-eye connector according to at least one embodiment of the present disclosure.

FIG. 3 illustrates a staggered press-fit fish-eye connector 300 according to at least one embodiment of the present disclosure. In an example, staggered press-fit fish-eye connector 300 includes multiple connectors 302, 304, and 306. In certain examples, press-fit fish-eye connectors 302 may be connectors for a ground pin, press-fit fish-eye connectors 304 and 306 are connectors for signals pins. A set of connectors 304 and 306 may be located between two ground connectors 306. Ground connectors 302 may provide shielding between one set of connectors 304 and 306 and another set of connectors 304 and 306. A set of connectors 304 and 306 may be a differential pair.

Signal connectors 304 and 306 may transmit any type of signal including, but not limited to, low speed signals and high speed signals. Press-fit fish-eye connectors 302, 304, and 306 shown in FIG. 3 may be a portion of an overall number of connector pins in staggered press-fit fish-eye connector 300. In certain examples, high speed signals utilize any suitable percentage of the communication connector including, but not limited to, 50%, 40%, 30%, and 20% of all signal connectors.

Figure 4:
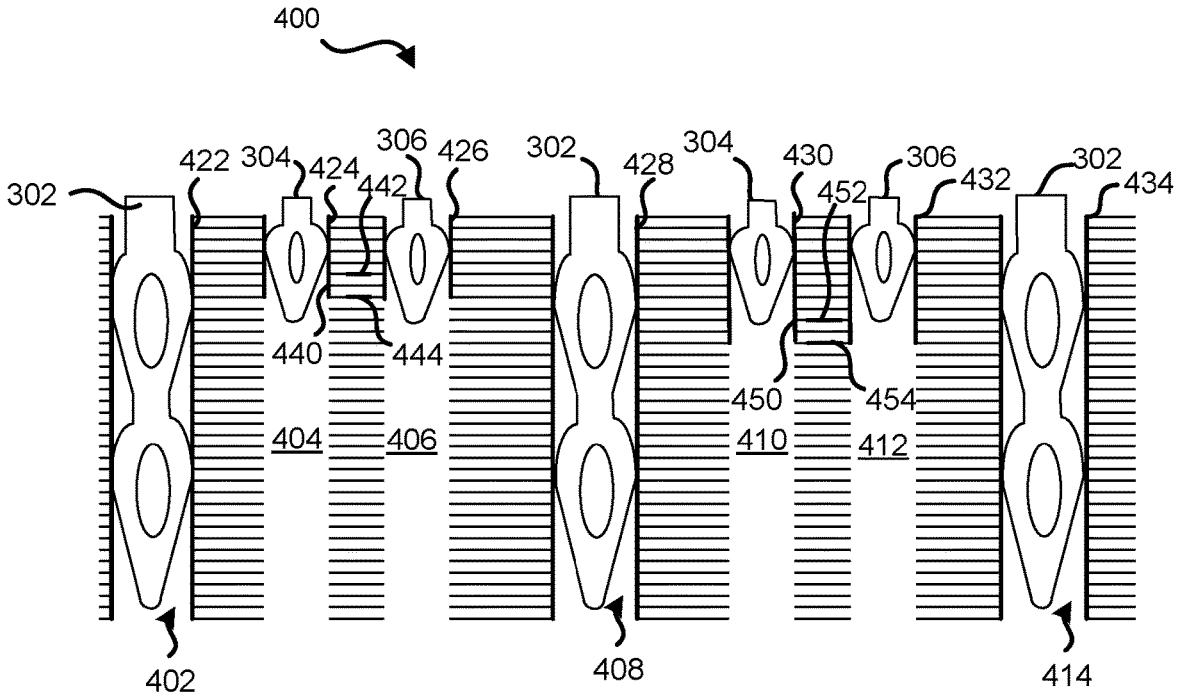
FIG. 4 is a diagram of the staggered press-fit fish-eye connector within a PCB according to at least one embodiment of the present disclosure.

In an example, press-fit fish-eye connectors 302 may be any suitable length 310 to provide mechanical strength and rigidity when pressed into a printed circuit board (PCB), such as PCB 400 of FIG. 4. For example, length 310 of press-fit fish-eye connectors 302 may be any suitable length including, but not limited to, 50 millimeters, 60 millimeters, 70 millimeters, 80 millimeters, and 90 millimeters. Press-fit fish-eye connectors 302 may include a multiple fish-eye structure to provide mechanical retention and strength to staggered press-fit fish-eye connector 300. In certain examples, press-fit fish-eye connectors 304 and 306 may be any suitable length 312 including, but not limited to, 20 millimeters, 25 millimeters, and 30 millimeters. In an example, length 310 of connectors 302 may be substantially equal to twice length 312 of connectors 304 and 306.

FIG. 4 illustrates staggered press-fit fish-eye connector 400 pressed within PCB 400 according to at least one embodiment of the present disclosure. PCB 400 represents circuit boards that provide a desired function for data processing, such as an information handling system. PCB 400 provides circuit traces, and component pads and through-hole mounting locations for the components that provide the functions and features of the information handling system. As such, PCB 400 will be understood to be fabricated as a multi-layer PCBs with various circuit traces formed on the front and back surfaces of the add-in card PCB, with various signal layers, power layers, and ground layers, and the like. The various circuit traces and layers may be formed of gold, nickel, tin, tin-lead, or other materials, as needed or desired.

The circuit trace layers, ground layers, and power layers are sandwiched between insulating layers of PCB material which may include pre-pregnated fiberglass, Duroid, FR4, epoxy resin, or the like, as needed or desired. The circuit trace layers, ground layers, and power layers may include copper layers, aluminum layers, iron layers, or the like, as needed or desired. In an assembly process of the information handling system, various components are placed onto PCB 400 in through-hole mounting locations, surface mounting locations, and the like, and in a solder reflow process, the connections of the components are electrically connected to the PCB. The details of PCB design and manufacturing, and electronic device assembly onto a PCB are known in the art, and will not be further described herein, except as needed to illustrate the current embodiments.

Among the various components that are assembled onto a PCB may include components that provide a high-speed data communication interface that is routed by the PCB between the components, or to connectors assembled onto the PCB to provide the high-speed data communication interface to other components, such as add-in cards, network connections, date connections, or other interfaces to components external to the PCB.

Such high-speed data communication interfaces may be single-ended data communication interfaces, where data is transmitted over a single trace and data is communicated with reference to a reference voltage, typically a ground voltage level, or the high-speed data communication interface may be double-ended data communication interfaces, where data is transmitted over a pair of signal traces and data is communicated as a differential signal between the pair of traces. As the speed of high-speed data communication interfaces increases, and the typical distance between the traces decreases, the susceptibility of the high-speed data communication interfaces to cross-talk from other nearby signal sources also increases.

PCB 400 includes multiple vias 402, 404, 406, 408, 410, 412, and 414, and each of the vias may be plated to provide communication between a press-fit fish-eye connector and one or more layers of PCB 400. During the assembly of PCB 400, via 402 may be plated with plating 422, via 404 may be plated with plating 424, via 406 may be plated with plating 426, via 408 includes at plating 428, via 410 may be plated with plating 430, via 412 may be plated with plating 432, and via 414 may be plated with plating 434.

If a ground connector will be pressed into a via, the entire plating may be left on the inner surface of the via, such as plating 422 on via 402, plating 428 on via 408, and plating 434 on via 414. If a signal connector is to be pressed into a via, the via may be back drilled to remove a portion of the plating, such as plating 424 on via 404, plating 426 on via 406, plating 430 on via 410, and plating 432 on via 412. In an example, a maximum amount of plating that may be backdrilled may be based on any suitable factors including, but not limited to, a length of the press-fit fish-eye connector to be pressed into the via and a layer of PCB 400 the connector will be in communication with. For example, minimum amount of platings 424 and 426 needed to be left after backdrilling may be a working zone of 18 millimters. In certain examples, a working zone of platings 430 and 432 may be more than the minimum amount. For example, the working zone of platings 430 and 432 may be any suitable length including a length above the minimum working zone.

Some high speed signal protocols, such as PCIe5, may be affected by signal reflections generated by stubs that are longer than a predetermined amount and connected to the communication layer. For example, PCIe5 may require that a stub is less than 10 millimeters. A stub 440 may be formed by a portion of plating 424 extending from a layer 442 of PCB 400 coupled to the plating and an end 444 of the plating. In an example, layer 424 may be any suitable layer of PCB 400, such as layer 3. In this example, stub 440 may be less than the maximum stub length allowed by PCIe5, such that layer 3 of PCB 400 may be utilized to transmit PCIe5 communication signals. The length of connectors 304 and 306 may enable the working zone lengths in vias 404 and 406 to be reduced, which in turn may enable additional routing layers, such as layer3, to be available in PCB 400.

In an example, a stub 450 may be formed by a portion of plating 430 extending from a layer 452 of PCB 400 coupled to the plating and an end 454 of the plating. The length of plating 430 remaining in PCB 400 after via 410 being backdrilled may be more than the minimum requirement for a working zone. In this situation, layer5 of PCB 400, indicated by 452, may be short enough to enable the high speed signal protocol to be utilized on layer5.

In certain examples, ground connectors 302 may be twice the length of connectors 304 and 306. Also, ground connectors 302 may include multiple fish-eye structures, which in turn may increase a number of contact points between the connector and plating of the via. In an example, the length and multiple fish-eye structures may increase a mechanical retention and strength for staggered press-fit fish-eye connector 400 as compared to previous single length connectors. In this example, the longer connectors 302 may enable signal connectors 304 and 306 to be shorter than previous press-fit connectors without losing mechanical retention and strength.

In an example, the shorter length of fish-eye connectors 304 and 306, the smaller the size of a via needed to receive the connector. In this situation, the smaller via, such as vias 404, 406, 410, and 412 may result in better signal integrity (SI) control within PCB 400 as compared to previous PCBs. In an example, the better SI performance as compared to previous PCBs may also be created based on shorter stubs.

Figure 5:
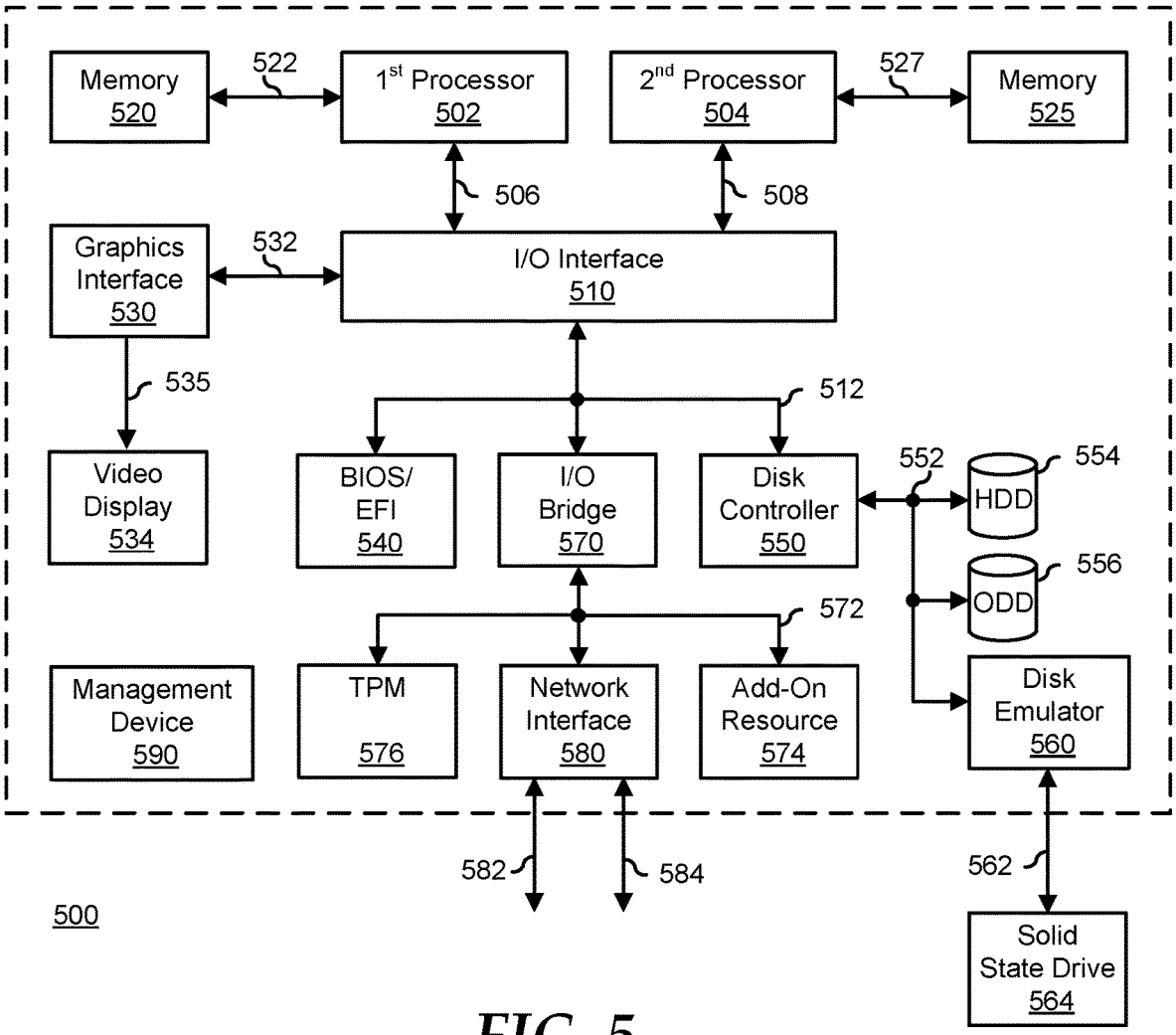
FIG. 5 is a block diagram illustrating a generalized information handling system according to another embodiment of the present disclosure.

FIG. 5 illustrates a generalized embodiment of an information handling system 500. For purpose of this disclosure an information handling system can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, information handling system 500 can be a personal computer, a laptop computer, a smart phone, a tablet device or other consumer electronic device, a network server, a network storage device, a switch router or other network communication device, or any other suitable device and may vary in size, shape, performance, functionality, and price.

Further, information handling system 500 can include processing resources for executing machine-executable code, such as a central processing unit (CPU), a programmable logic array (PLA), an embedded device such as a System-on-a-Chip (SoC), or other control logic hardware. Information handling system 500 can also include one or more computer-readable medium for storing machine-executable code, such as software or data. Additional components of information handling system 500 can include one or more storage devices that can store machine-executable code, one or more communications ports for communicating with external devices, and various input and output (I/O) devices, such as a keyboard, a mouse, and a video display. Information handling system 500 can also include one or more buses operable to transmit information between the various hardware components.

Information handling system 500 can include devices or modules that embody one or more of the devices or modules described below, and operates to perform one or more of the methods described below. Information handling system 500 includes a processors 502 and 504, an input/output (I/O) interface 510, memories 520 and 525, a graphics interface 530, a basic input and output system/universal extensible firmware interface (BIOS/UEFI) module 540, a disk controller 550, a hard disk drive (HDD) 554, an optical disk drive (ODD) 556, a disk emulator 560 connected to an external solid state drive (SSD) 562, an I/O bridge 570, one or more add-on resources 574, a trusted platform module (TPM) 576, a network interface 580, and a management device 590. Processors 502 and 504, I/O interface 510, memory 520, graphics interface 530, BIOS/UEFI module 540, disk controller 550, HDD 554, ODD 556, disk emulator 560, SSD 562, I/O bridge 570, add-on resources 574, TPM 576, and network interface 580 operate together to provide a host environment of information handling system 500 that operates to provide the data processing functionality of the information handling system. The host environment operates to execute machine-executable code, including platform BIOS/UEFI code, device firmware, operating system code, applications, programs, and the like, to perform the data processing tasks associated with information handling system 500.

In the host environment, processor 502 is connected to I/O interface 510 via processor interface 506, and processor 504 is connected to the I/O interface via processor interface 508. Memory 520 is connected to processor 502 via a memory interface 522. Memory 525 is connected to processor 504 via a memory interface 527. Graphics interface 530 is connected to I/O interface 510 via a graphics interface 532, and provides a video display output 535 to a video display 534. In a particular embodiment, information handling system 500 includes separate memories that are dedicated to each of processors 502 and 504 via separate memory interfaces. An example of memories 520 and 525 include random access memory (RAM) such as static RAM (SRAM), dynamic RAM (DRAM), non-volatile RAM (NV-RAM), or the like, read only memory (ROM), another type of memory, or a combination thereof.

BIOS/UEFI module 540, disk controller 550, and I/O bridge 570 are connected to I/O interface 510 via an I/O channel 512. An example of I/O channel 512 includes a Peripheral Component Interconnect (PCI) interface, a PCI-Extended (PCI-X) interface, a high-speed PCI-Express (PCIe) interface, another industry standard or proprietary communication interface, or a combination thereof. I/O interface 510 can also include one or more other I/O interfaces, including an Industry Standard Architecture (ISA) interface, a Small Computer Serial Interface (SCSI) interface, an Inter-Integrated Circuit ($I^2C$) interface, a System Packet Interface (SPI), a Universal Serial Bus (USB), another interface, or a combination thereof. BIOS/UEFI module 540 includes BIOS/UEFI code operable to detect resources within information handling system 500, to provide drivers for the resources, initialize the resources, and access the resources. BIOS/UEFI module 540 includes code that operates to detect resources within information handling system 500, to provide drivers for the resources, to initialize the resources, and to access the resources.

Disk controller 550 includes a disk interface 552 that connects the disk controller to HDD 554, to ODD 556, and to disk emulator 560. An example of disk interface 552 includes an Integrated Drive Electronics (IDE) interface, an Advanced Technology Attachment (ATA) such as a parallel ATA (PATA) interface or a serial ATA (SATA) interface, a SCSI interface, a USB interface, a proprietary interface, or a combination thereof. Disk emulator 560 permits SSD 564 to be connected to information handling system 500 via an external interface 562. An example of external interface 562 includes a USB interface, an IEEE 1394 (Firewire) interface, a proprietary interface, or a combination thereof. Alternatively, solid-state drive 564 can be disposed within information handling system 500.

I/O bridge 570 includes a peripheral interface 572 that connects the I/O bridge to add-on resource 574, to TPM 576, and to network interface 580. Peripheral interface 572 can be the same type of interface as I/O channel 512, or can be a different type of interface. As such, I/O bridge 570 extends the capacity of I/O channel 512 when peripheral interface 572 and the I/O channel are of the same type, and the I/O bridge translates information from a format suitable to the I/O channel to a format suitable to the peripheral channel 572 when they are of a different type. Add-on resource 574 can include a data storage system, an additional graphics interface, a network interface card (NIC), a sound/video processing card, another add-on resource, or a combination thereof. Add-on resource 574 can be on a main circuit board, on separate circuit board or add-in card disposed within information handling system 500, a device that is external to the information handling system, or a combination thereof.

Network interface 580 represents a NIC disposed within information handling system 500, on a main circuit board of the information handling system, integrated onto another component such as I/O interface 510, in another suitable location, or a combination thereof. Network interface device 580 includes network channels 582 and 584 that provide interfaces to devices that are external to information handling system 500. In a particular embodiment, network channels 582 and 584 are of a different type than peripheral channel 572 and network interface 580 translates information from a format suitable to the peripheral channel to a format suitable to external devices. An example of network channels 582 and 584 includes InfiniBand channels, Fibre Channel channels, Gigabit Ethernet channels, proprietary channel architectures, or a combination thereof. Network channels 582 and 584 can be connected to external network resources (not illustrated). The network resource can include another information handling system, a data storage system, another network, a grid management system, another suitable resource, or a combination thereof.

Management device 590 represents one or more processing devices, such as a dedicated baseboard management controller (BMC) System-on-a-Chip (SoC) device, one or more associated memory devices, one or more network interface devices, a complex programmable logic device (CPLD), and the like, that operate together to provide the management environment for information handling system 500. In particular, management device 590 is connected to various components of the host environment via various internal communication interfaces, such as a Low Pin Count (LPC) interface, an Inter-Integrated-Circuit (I2C) interface, a PCIe interface, or the like, to provide an out-of-band (OOB) mechanism to retrieve information related to the operation of the host environment, to provide BIOS/UEFI or system firmware updates, to manage non-processing components of information handling system 500, such as system cooling fans and power supplies. Management device 590 can include a network connection to an external management system, and the management device can communicate with the management system to report status information for information handling system 500, to receive BIOS/UEFI or system firmware updates, or to perform other task for managing and controlling the operation of information handling system 500. Management device 590 can operate off of a separate power plane from the components of the host environment so that the management device receives power to manage information handling system 500 when the information handling system is otherwise shut down. An example of management device 590 include a commercially available BMC product or other device that operates in accordance with an Intelligent Platform Management Initiative (IPMI) specification, a Web Services Management (WSMan) interface, a Redfish Application Programming Interface (API), another Distributed Management Task Force (DMTF), or other management standard, and can include an Integrated Dell Remote Access Controller (iDRAC), an Embedded Controller (EC), or the like. Management device 590 may further include associated memory devices, logic devices, security devices, or the like, as needed or desired.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A staggered press-fit fish-eye connector for an information handling system, the staggered press-fit fish-eye connector comprising:

a plurality of ground press-fit connectors including first, second, and third ground press-fit connectors, wherein each of the ground press-fit connectors includes multiple fish-eye structures; and a plurality of signal press-fit connectors including first, second, third and fourth signal press-fit connectors, wherein each of the signal press-fit connectors includes a single fish-eye structure, wherein the ground press-fit connectors are substantially longer than the signal press-fit connectors, wherein the first and second signal press-fit connectors are located between the first and second ground press-fit connectors, and the third and fourth signal press-fit connectors are located between the second and third ground press-fit connectors.

2. The staggered press-fit fish-eye connector of claim 1, wherein all of the signal press-fit connectors are substantially a same length.

3. The staggered press-fit fish-eye connector of claim 1, wherein each of the ground press-fit connectors includes multiple fish-eye structures.

4. The staggered press-fit fish-eye connector of claim 1, wherein the first and second signal press-fit connectors are differential pairs.

5. The staggered press-fit fish-eye connector of claim 1, wherein a length of the ground press-fit connectors provides strength to the staggered press-fit fish-eye connector.

6. An information handling system comprising:

a staggered press-fit fish-eye connector including:

a plurality of ground press-fit connectors including first, second, and third ground press-fit connectors, wherein each of the ground press-fit connectors includes multiple fish-eye structures; and a plurality of signal press-fit connectors including first, second, third and fourth signal press-fit connectors, wherein each of the signal press-fit connectors includes a single fish-eye structure, wherein the ground press-fit connectors are substantially longer than the signal press-fit connectors, wherein the first and second signal press-fit connectors are located between the first and second ground press-fit connectors, and the third and fourth signal press-fit connectors are located between the second and third ground press-fit connectors; and a printed circuit board including a plurality of vias, wherein each ground press-fit connectors and each signal press-fit connector is pressed into a corresponding via of the vias.

7. The information handling system of claim 6, wherein all of the signal press-fit connectors are substantially a same length.

8. The information handling system of claim 6, wherein each of the ground press-fit connectors includes multiple fish-eye structures.

9. The information handling system of claim 8, wherein the multiple fish-eye structures of each of the ground press-fit connectors provides retention of the staggered press-fit fish-eye connector within the vias of the printed circuit board.

10. The information handling system of claim 6, wherein the first and second signal press-fit connectors are differential pairs.

11. The information handling system of claim 6, wherein a length of the ground press-fit connectors provides strength to the staggered press-fit fish-eye connector.

12. The information handling system of claim 6, wherein each via in a subset of the vias include a working zone that is substantially less than an entire length of the respective via.

13. The information handling system of claim 12, wherein a minimum overall length of a first working zone in a first via is based on a length of the first signal press-fit connector pressed in the first via.

14. The information handling system of claim 13, wherein the first working zone of the first via includes a stub extending from a layer of the printed circuit board to an end of the first working zone.

15. The information handling system of claim 14, wherein a length of the stub is affected by the length of the first signal press-fit connector, and a signal integrity of the first signal press-fit connector improves as the length of the stub is shorter.

16. An information handling system comprising:

a staggered press-fit fish-eye connector including:

first, second, and third ground press-fit connectors, wherein each of the ground press-fit connectors includes multiple fish-eye structures; and first, second, third and fourth signal press-fit connectors, wherein each of the signal press-fit connectors includes a single fish-eye structure, wherein the ground press-fit connectors are substantially longer than the signal press-fit connectors, wherein the first and second signal press-fit connectors are located between the first and second ground press-fit connectors, and the third and fourth signal press-fit connectors are located between the second and third ground press-fit connectors; and a printed circuit board including a plurality of vias, wherein each ground press-fit connectors and each signal press-fit connector is pressed into a corresponding one of the vias, wherein the multiple fish-eye structures of each of the ground press-fit connectors provides retention of the staggered press-fit fish-eye connector within the vias of the printed circuit board, wherein a length of the ground press-fit connectors provides strength to the staggered press-fit fish-eye connector within the via of the printed circuit board.

17. The information handling system of claim 16, wherein all of the signal press-fit connectors are substantially a same length.

18. The information handling system of claim 16, wherein each via in a subset of the vias include a working zone that is substantially less than an entire length of the respective via.

19. The information handling system of claim 18, wherein a minimum overall length of a first working zone in a first via is based on a length of the first signal press-fit connector pressed in the first via.

20. The information handling system of claim 16, wherein the first working zone of the first via includes a stub extending from a layer of the printed circuit board to an end of the first working zone.

* * * * *